US008408872B2

(12) United States Patent
Briggs et al.

(10) Patent No.: US 8,408,872 B2
(45) Date of Patent: Apr. 2, 2013

(54) FASTBACK TURBULATOR STRUCTURE AND TURBINE NOZZLE INCORPORATING SAME

(75) Inventors: Robert David Briggs, West Chester, OH (US); Shawn Michael Pearson, Sharonville, OH (US); John Creighton Schilling, Sharonville, OH (US)

(73) Assignee: General Electric Company, Schenectady, NY (US)

( * ) Notice: Subject to any disclaimer, the term of this patent is extended or adjusted under 35 U.S.C. 154(b) by 713 days.

(21) Appl. No.: 12/618,241

(22) Filed: Nov. 13, 2009

(65) Prior Publication Data

US 2011/0070075 A1 Mar. 24, 2011

Related U.S. Application Data

(60) Provisional application No. 61/245,649, filed on Sep. 24, 2009.

(51) Int. Cl.
*F01D 5/08* (2006.01)
*F01D 5/18* (2006.01)

(52) U.S. Cl. ..... 416/97 R; 416/92; 416/96 R; 415/115

(58) Field of Classification Search ..... 415/115; 416/96 R, 97 R, 92
See application file for complete search history.

(56) References Cited

U.S. PATENT DOCUMENTS

| | | | | |
|---|---|---|---|---|
| 5,361,828 | A | 11/1994 | Lee et al. | |
| 5,626,017 | A | 5/1997 | Sattelmayer | |
| 6,000,466 | A | 12/1999 | Aoyagi et al. | |
| 6,026,892 | A | 2/2000 | Kim et al. | |
| 6,896,509 | B2 * | 5/2005 | Carroni et al. | 415/115 |
| 7,699,583 | B2 * | 4/2010 | Cunha | 416/97 R |
| 8,186,942 | B2 * | 5/2012 | Haas | 415/145 |

FOREIGN PATENT DOCUMENTS

| | | |
|---|---|---|
| EP | 0845580 A2 | 6/1998 |
| EP | 1882818 A1 | 1/2008 |

OTHER PUBLICATIONS

GB 1015936.6, Great Britain Search Report and Written Opinion, Jan. 14, 2011.

* cited by examiner

*Primary Examiner* — Igor Kershteyn
(74) *Attorney, Agent, or Firm* — General Electric Company; David J. Clement; Matthew P. Hayden

(57) ABSTRACT

A heat transfer apparatus, includes a member defining a wall exposed to fluid flow in a predetermined direction of flow; and a plurality of turbulators disposed on the wall. Each turbulator includes an upright front face which generally faces the direction of flow, and a back face which defines a ramp-like shape tapering from the front face to the wall.

16 Claims, 8 Drawing Sheets

FASTBACK TURBULATOR STRUCTURE AND TURBINE NOZZLE INCORPORATING SAME

CROSS-REFERENCE TO RELATED APPLICATIONS

This application claims the benefit of Provisional Patent Application 61/245,649, filed Sep. 24, 2009.

BACKGROUND OF THE INVENTION

This invention relates generally to heat transfer in gas turbine engines and more particularly to apparatus for cooling structures in such engines.

A gas turbine engine includes a turbomachinery core having a high pressure compressor, combustor, and high pressure turbine ("HPT") in serial flow relationship. The core is operable in a known manner to generate a primary gas flow. The high pressure turbine includes annular arrays ("rows") of stationary vanes or nozzles that direct the gases exiting the combustor into rotating blades or buckets. Collectively one row of nozzles and one row of blades make up a "stage". Typically two or more stages are used in serial flow relationship. The combustor and HPT components operate in an extremely high temperature environment, and must be cooled by air flow to ensure adequate service life.

Cooling air flow is typically provided by utilizing relatively lower-temperature "bleed" air extracted from an upstream part of the engine, for example the high pressure compressor, and then feeding that bleed air to high-temperature downstream components. The bleed air may be applied in numerous ways, for example through internal convection cooling or through film cooling. When used for convection cooling, the bleed air is often routed through serpentine passages or other structures which generate a pressure loss as the cooling air passes through them. Because bleed air represents a loss to the engine cycle and reduces efficiency, it is desired to maximize heat transfer rates and thereby use the minimum amount of cooling flow possible. For this reason heat transfer improvement structures, such as turbulence promoters or "turbulators", are often formed on cooled surfaces.

Turbulators are elongated strips or ribs having a square, rectangular, or other symmetric cross-section, and are generally aligned transverse to the direction of flow. The turbulators serve to "trip" the boundary layer at the component surface and create turbulence which increases heat transfer. Cooling effectiveness is thereby increased. One problem with the use of conventional turbulators is that a flow stagnation zone is present downstream of each turbulator. This zone causes dust, which is naturally entrained in the cooling air, to be deposited and build up behind the turbulators. This build-up is an insulating layer which reduces heat transfer also can cause undesirable wear.

An example of a particular gas turbine engine structure requiring effective cooling is an HPT nozzle. HPT nozzles are often configured as an array of airfoil-shaped vanes extending between annular inner and outer bands which define the primary flowpath through the nozzle. Some prior art HPT nozzles have experienced temperatures on the aft inner band above the design intent. This has lead to the loss of the aft inner band because of oxidation at a low number of engine cycles. The material loss can trigger a chain of undesirable events, leading to serious engine failures. For example, in a multi-stage HPT, the loss of the aft portion of the first stage nozzle inner band can cause hot gas ingestion between the first stage nozzle and the forward rotating seal member or "angel wing" of the adjacent first stage blade. The ingested primary flow can in turn heat up the forward cooling plate of the first stage rotor disk causing it to crack. Once the cooling plate is cracked, hot air can heat up the first stage rotor disk causing damage to the disk post, which could lead to the release of a first stage turbine blade.

BRIEF SUMMARY OF THE INVENTION

These and other shortcomings of the prior art are addressed by the present invention, which provides a "fastback" turbulator structure that discourages stagnation of high velocity flow.

According to one aspect of the invention, a heat transfer apparatus includes: (a) a member defining a wall exposed to fluid flow in a predetermined direction of flow; and (b) a plurality of turbulators disposed on the wall, each turbulator having: (i) an upright front face which generally faces the direction of flow, and (ii) a back face which defines a ramp-like shape tapering from the front face to the wall.

According to another aspect of the invention, a turbine nozzle includes: (a) a hollow, airfoil-shaped turbine vane; (b) an arcuate first band disposed at a first end of the turbine vane, the first band having a flowpath face adjacent the turbine vane, and an opposed back face; (c) wherein the back face includes at least one open pocket, the at least one pocket defined in part by a bottom wall recessed from the back face, opposed ends of the bottom wall merging with the back face, where the pocket is exposed to fluid flow in a predetermined direction of flow; and (d) a plurality of turbulators disposed on the bottom wall, each turbulator having: (i) an upright front face which generally faces the direction of flow, and (ii) a back face which defines a ramp-like shape tapering from the front face to the bottom wall of the pocket.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
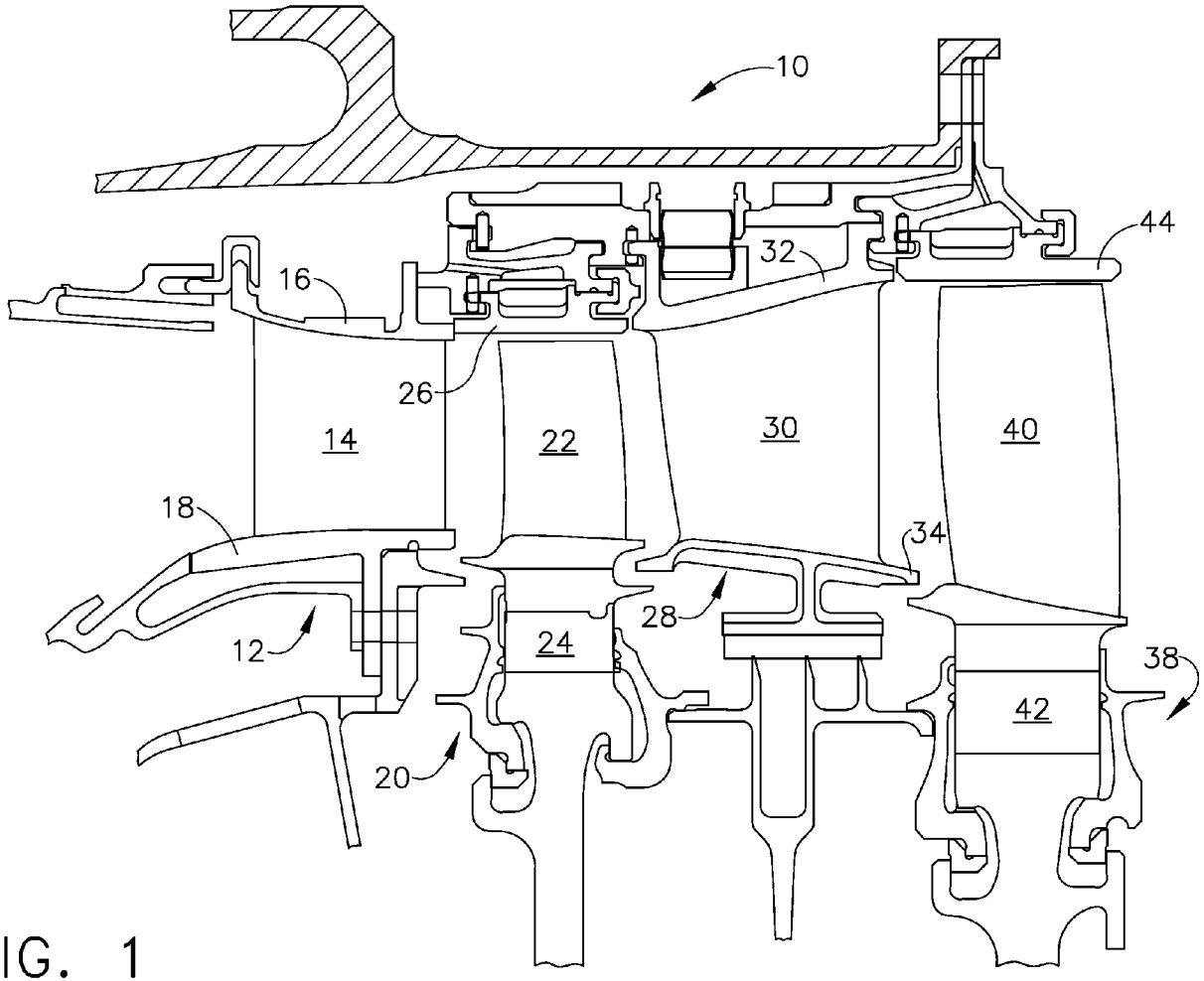
FIG. 1 is a cross-sectional view of a high pressure turbine section of a gas turbine engine, constructed in accordance with an aspect of the present invention.

Referring to the drawings wherein identical reference numerals denote the same elements throughout the various views, FIG. 1 depicts a portion of a high pressure turbine 10, which is part of a gas turbine engine of a known type. The function of the high pressure turbine 10 is to extract energy from high-temperature, pressurized combustion gases from an upstream combustor (not shown) and to convert the energy to mechanical work, in a known manner. The high pressure turbine 10 drives an upstream compressor (not shown) through a shaft so as to supply pressurized air to a combustor.

In the illustrated example, the engine is a turbofan engine and a low pressure turbine (not shown) would be located downstream of the gas generator turbine 10 and coupled to a shaft driving a fan. However, the principles described herein are equally applicable to turboprop and turbojet engines, as well as turbine engines used for other vehicles or in stationary applications.

The high pressure turbine 10 includes a first stage nozzle 12 which comprises a plurality of circumferentially spaced airfoil-shaped hollow first stage vanes 14 that are supported between an arcuate, segmented first stage outer band 16 and an arcuate, segmented first stage inner band 18. The first stage vanes 14, first stage outer band 16, and first stage inner band 18 are arranged into a plurality of circumferentially adjoining nozzle segments that collectively form a complete 360° assembly. The first stage outer and inner bands 16 and 18 define the outer and inner radial flowpath boundaries, respectively, for the hot gas stream flowing through the first stage nozzle 12. The first stage vanes 14 are configured so as to optimally direct the combustion gases to a first stage rotor 20.

The first stage rotor 20 includes an array of airfoil-shaped first stage turbine blades 22 extending outwardly from a first stage disk 24 that rotates about the centerline axis of the engine. A segmented, arcuate first stage shroud 26 is arranged so as to closely surround the first stage turbine blades 22 and thereby define the outer radial flowpath boundary for the hot gas stream flowing through the first stage rotor 20.

A second stage nozzle 28 is positioned downstream of the first stage rotor 20, and comprises a plurality of circumferentially spaced airfoil-shaped hollow second stage vanes 30 that are supported between an arcuate, segmented second stage outer band 32 and an arcuate, segmented second stage inner band 34. The second stage vanes 30, second stage outer band 32 and second stage inner band 34 are arranged into a plurality of circumferentially adjoining nozzle segments that collectively form a complete 360° assembly. The second stage outer and inner bands 32 and 34 define the outer and inner radial flowpath boundaries, respectively, for the hot gas stream flowing through the second stage turbine nozzle 34. The second stage vanes 30 are configured so as to optimally direct the combustion gases to a second stage rotor 38.

The second stage rotor 38 includes a radial array of airfoil-shaped second stage turbine blades 40 extending radially outwardly from a second stage disk 42 that rotates about the centerline axis of the engine. A segmented arcuate second stage shroud 44 is arranged so as to closely surround the second stage turbine blades 40 and thereby define the outer radial flowpath boundary for the hot gas stream flowing through the second stage rotor 38.

Figure 2:
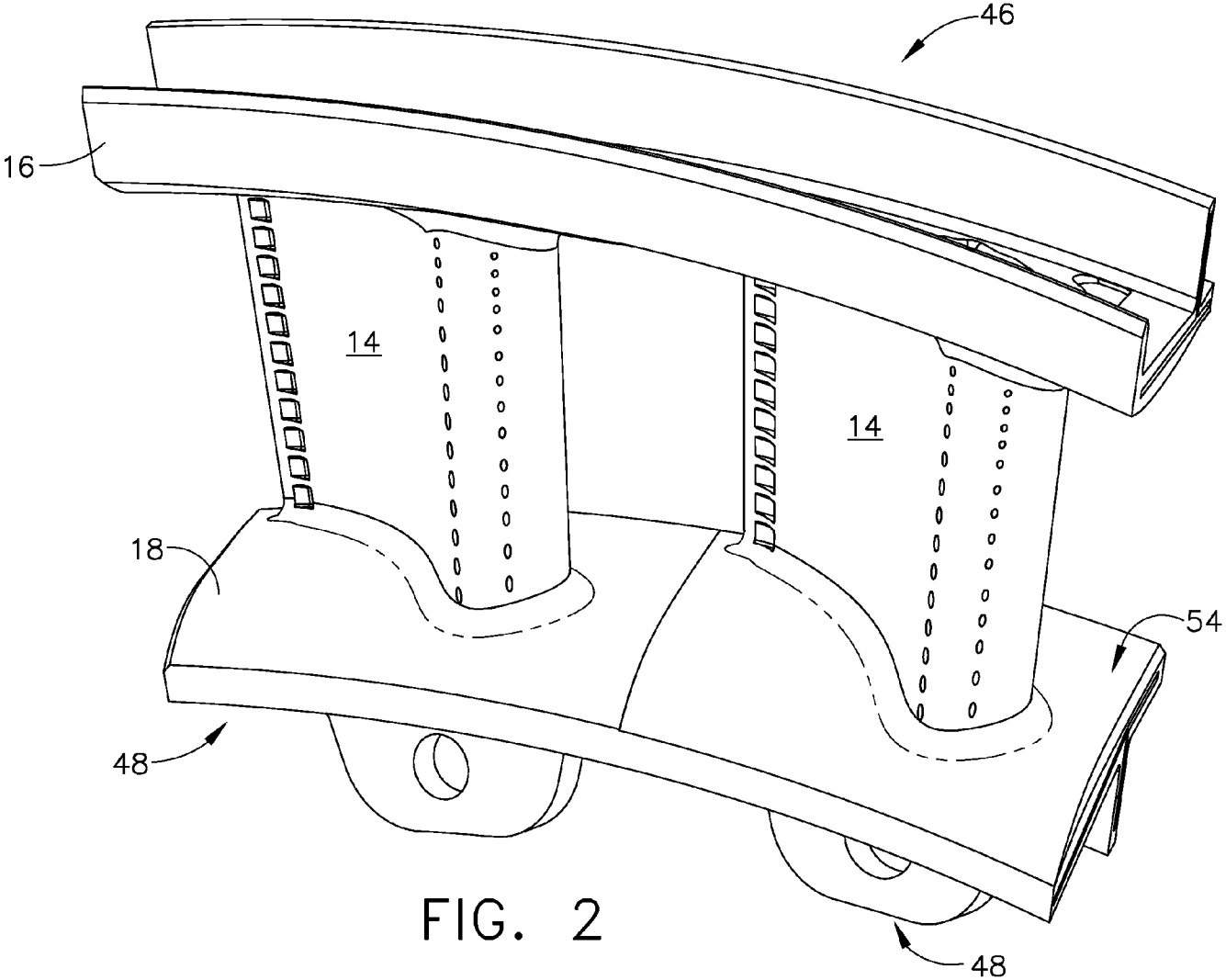
FIG. 2 is a perspective view of a turbine nozzle segment.
Figure 3:
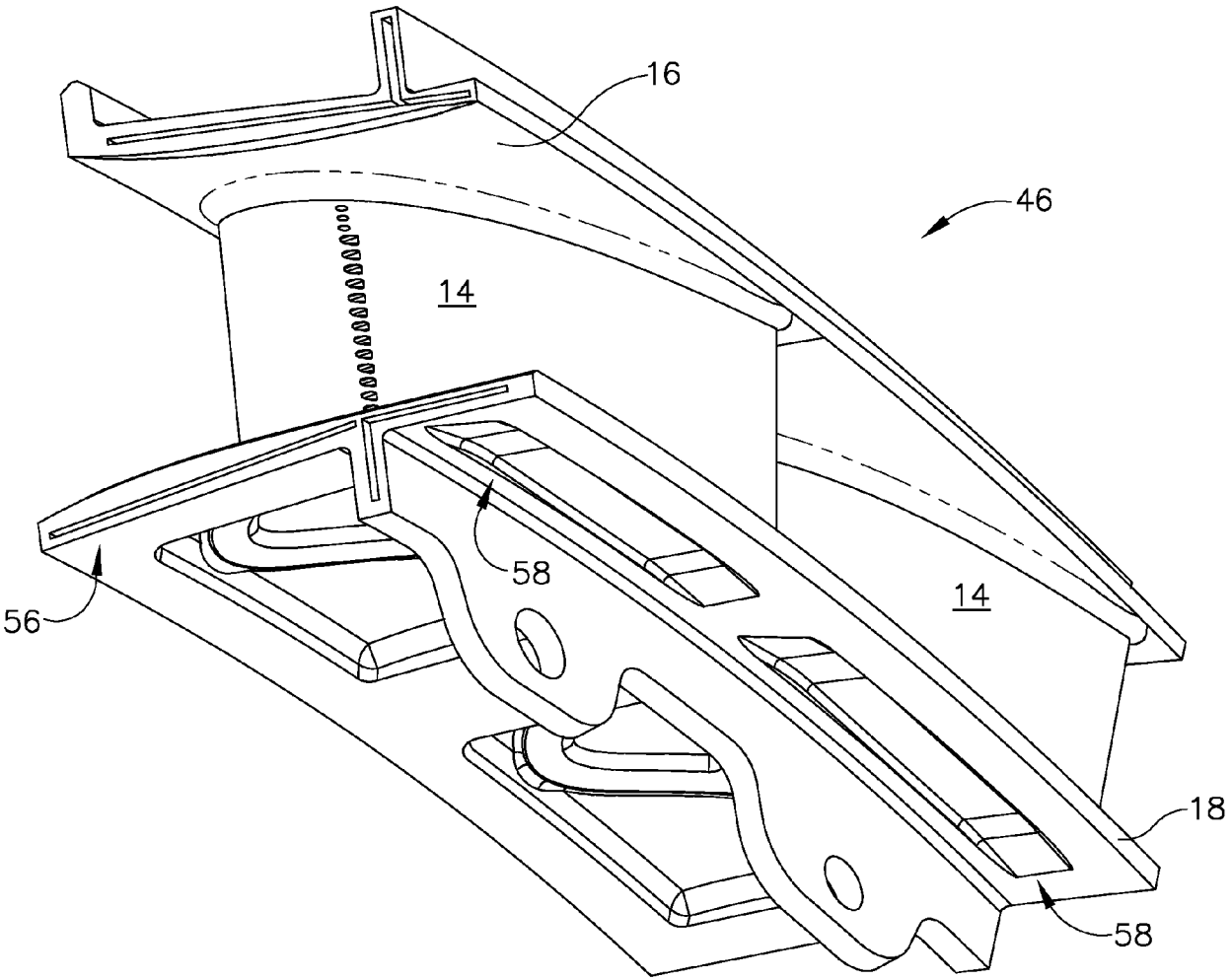
FIG. 3 is another perspective view of a turbine nozzle segment.

FIGS. 2 and 3 illustrate one of the several nozzle segments 46 that make up the first stage nozzle 12. The nozzle segment 46 comprises two individual "singlet" castings 48 which are arranged side-by side and bonded together, for example by brazing, to form a unitary component. Each singlet 48 is cast from a known material having suitable high-temperature properties such as a nickel- or cobalt-based "superalloy" and includes a segment of the outer band 16, a segment of the inner band 18, and a hollow first stage vane 14. The concepts described herein are equally applicable to turbine nozzles made from "doublet" castings as well as multiple-vane castings and continuous turbine nozzle rings.

The inner band 18 has a flowpath face 54 and an opposed back face 56. One or more open pockets 58 are formed in the back face 56. The pockets 58 may be formed by incorporating them into the casting, by machining, or by a combination of techniques.

Figure 4:
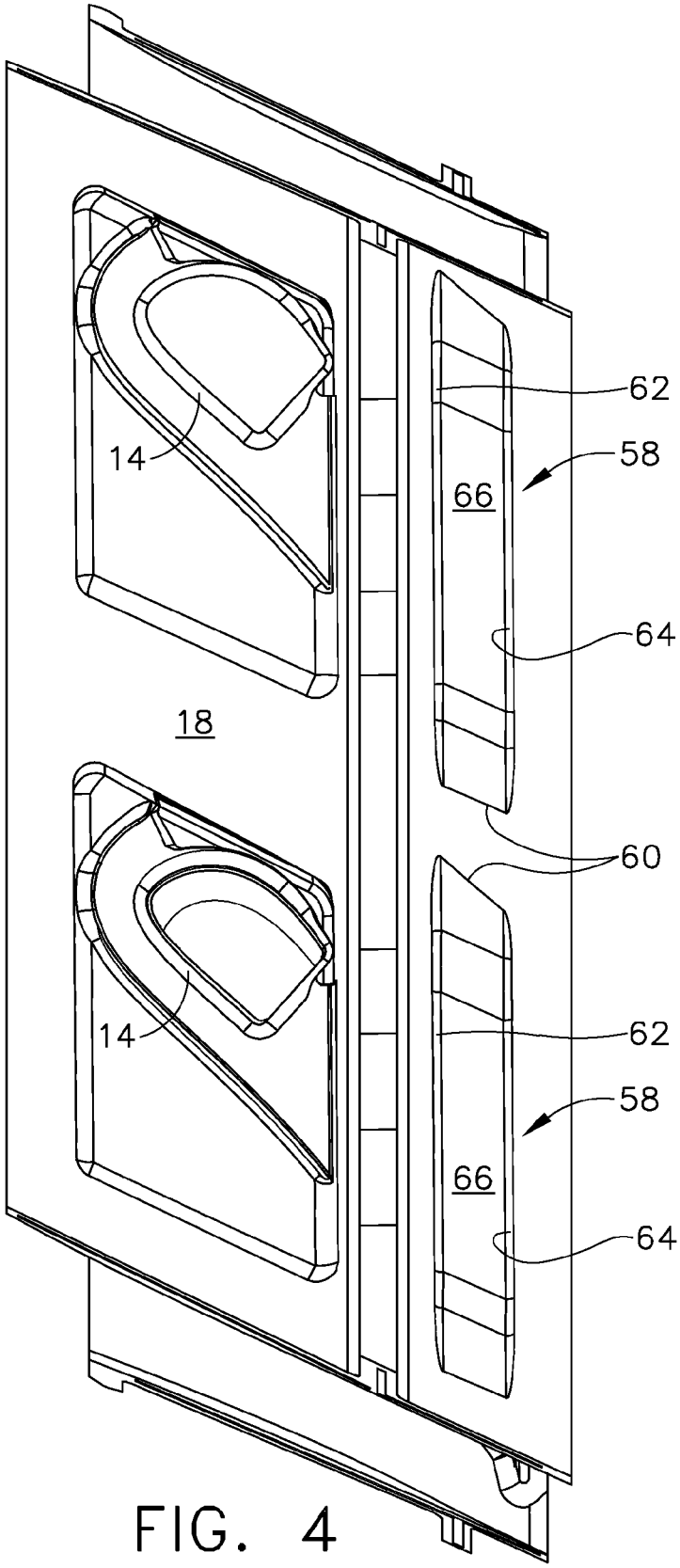
FIG. 4 is bottom view of the turbine nozzle segment of FIG. 2.
Figure 5:
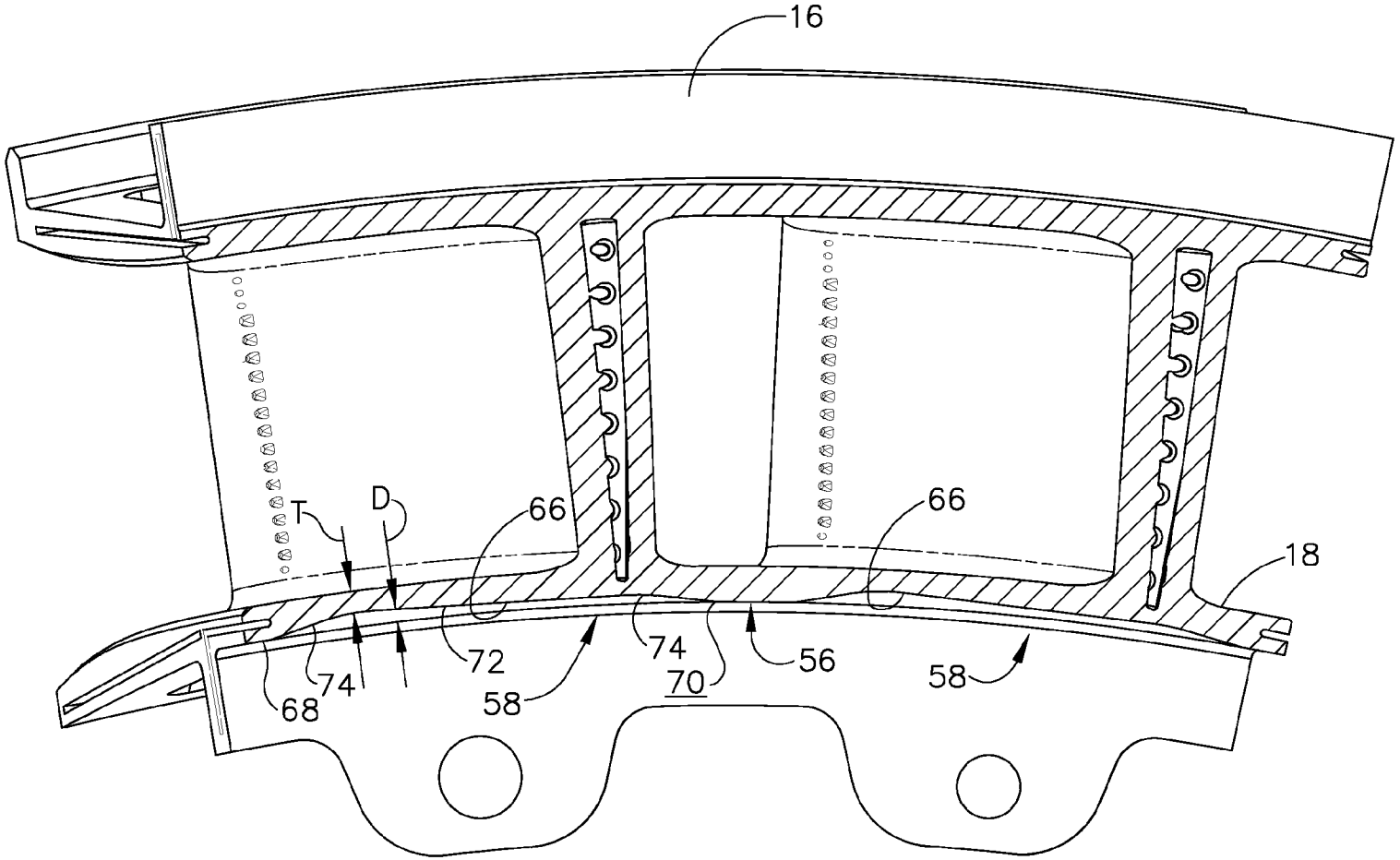
FIG. 5 is a transverse sectional view of the turbine nozzle segment of FIG. 2.
Figure 6:
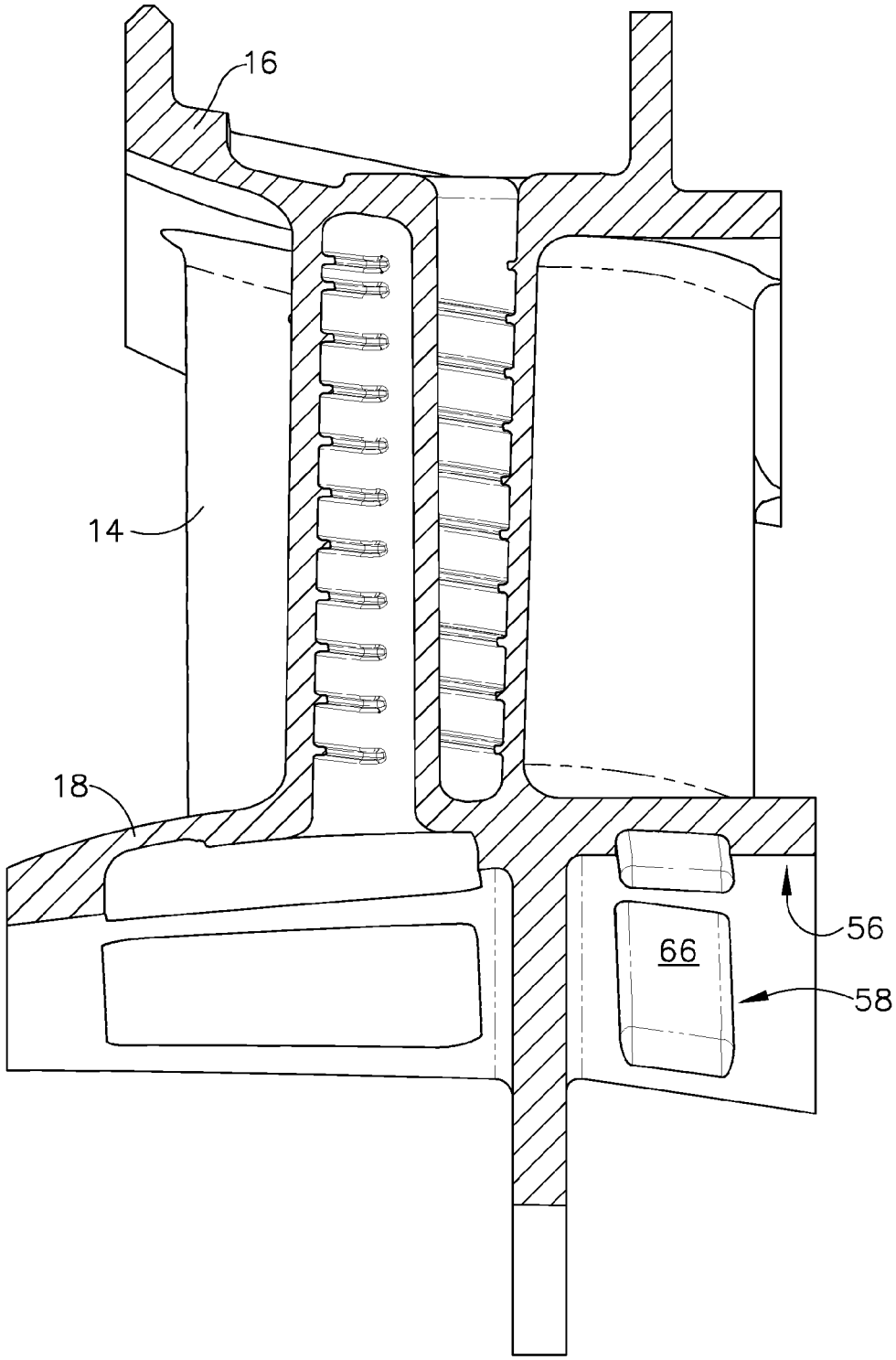
FIG. 6 is a cross-sectional view of the turbine nozzle of FIG. 2.

FIGS. 4-6 illustrate the pockets 58 in more detail. Each pocket 58 has an open peripheral edge 60. The pocket's shape is bounded and collectively defined by a forward wall 62, an aft wall 64, and a bottom wall 66. The forward and aft walls 62 and 64 are generally planar, parallel to each other, and aligned in a radial direction. Their shape is not critical to the operation of the present invention.

The bottom wall 66 extends in a generally circumferential direction between first and second ends 68 and 70. The bottom wall 66 includes a central portion 72 which is recessed from the back face 56 and two end portions 74. The end portions 74 form ramps between the central portion 72 and the back face 56. The central portion 72 may define a portion of a circular arc, or another suitable curved profile.

The distance that the bottom wall 66 is offset from the back face 56 in a radial direction is referred to as the "depth" of the pocket 58 and is denoted "D". The specific value of "D" varies at each location of the pocket 58, generally being the greatest near the circumferential midpoint of the pocket 58 and tapering to zero at the ends 68 and 70. It is desirable for weight reduction purposes to make the depth "D" as large as possible. The maximum depth achievable is limited by the minimum acceptable material thickness in the inner band 18 and the vane 14, shown at "T" (see FIG. 5). As an example a minimum thickness may be about 1.0 mm (0.040 in.).

Figure 7:
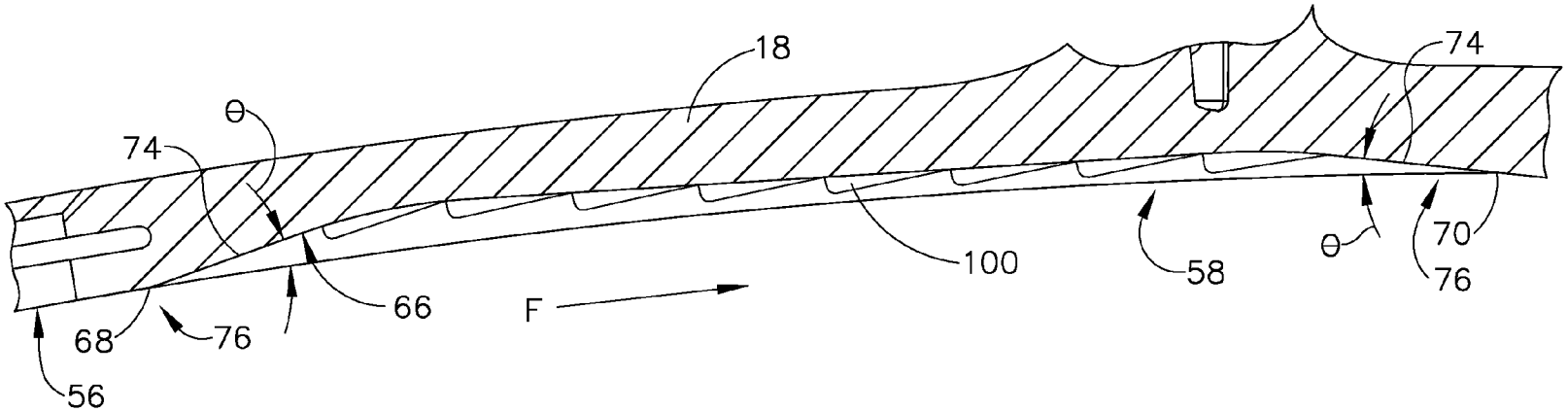
FIG. 7 is a transverse sectional view of a portion of the inner band of the turbine nozzle segment of FIG. 2, with a plurality of turbulators added thereto.

FIG. 7 illustrates the profile of the pocket 58 in transverse section. Each of the end portions 74 is disposed at a non-perpendicular, non-parallel angle θ to the back face 56 of the inner band 18. The angle θ will vary to suit a particular application, however analysis suggests that a ramp angle θ of about 20° or less will minimize or eliminate recirculation. In any case, the bottom wall 66 is substantially free of any sharp transitions or small-radius curves that would constitute interior corners. A smooth transition region may be provided at the intersection of the end portions 74 and the back face 56. For example, a lead-in section 76 disposed at an angle of about 2° to about 3° to the back face 56, and smoothly radiused into the end portion 74, or a simple convex radiused shape, may be used.

As shown in FIG. 7, the pocket 58 may optionally be provided with a plurality of turbulence promoters commonly referred to as "turbulators" 100. The turbulators 100 are raised ribs extending across the pocket 58. They are generally aligned transverse to the direction of flow across the pocket 58, depicted by an arrow "F", however if desired they may be oriented at a different angle relative to the airflow. The turbulators 100 serve to "trip" the boundary layer at the component surface (i.e. bottom wall 66) and create turbulence which increases heat transfer as air passes over them. Cooling effectiveness is thereby increased.

Figure 8:
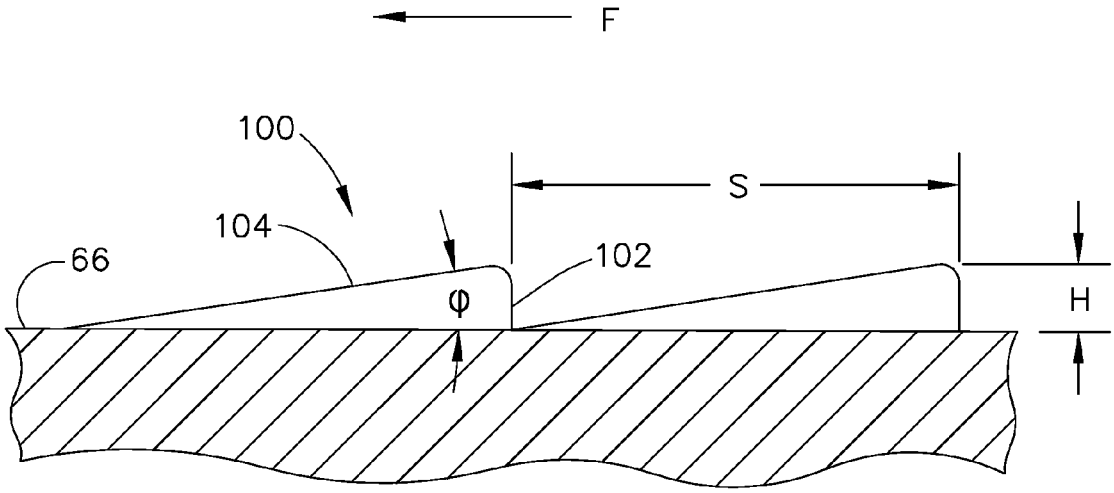
FIG. 8 is an enlarged view of a portion of FIG. 7.

Unlike prior art turbulators described above, the turbulators 100 are shaped so as to avoid flow stagnation and dust buildup. In particular, with reference to FIG. 8, each turbulator 100 has an upright front face 102 which generally faces the direction of cooling flow, and a back face 104 which defines a ramp-like shape tapering back from the front face 102 to the bottom wall 66 of the pocket 58. This general shape is referred to herein as a "fastback" shape. A radius or blended shape may be formed at the junction between the front face 102 and the back face 104.

The peak height "H" of the turbulator 100 above the bottom wall 66 is selected in accordance with prior art practice, and is large enough so that each turbulator 100 is effective in producing turbulence, that is, the turbulator 100 is significantly taller than surface imperfections in the cast component surface, but generally not so large as to form a significant flow blockage. For example, the height "H" may be from about 0.18 mm (0.007 in.) to about 0.64 mm (0.025 in.). A height of about 0.25 mm (0.010 in.) is believed to be a preferred value in the specific example illustrated.

The turbulators 100 are spaced-apart from each other in the direction of cooling air flow by a distance "S" which is selected to suit the specific application. As a general rule of thumb, the distance S may be about 8 to 10 times the height H.

As illustrated, the back face 104 is substantially planar over the majority of its surface and is inclined so as to give the turbulator 100 an included angle $\phi$. The angle $\phi$ is selected to be large enough so that each turbulator 100 has a reasonable overall length (i.e. in the direction of cooling air flow), but not so large that a stagnation zone would be present during operation. As an example, the angle $\phi$ may be about 20° or less. It is believed that an angle $\phi$ of about 7° is a preferred value for preventing recirculation. The back face 104 of each turbulator 100 may extend all the way to the root of the front face 102 of the downstream turbulator, or it may terminate at a shorter distance, leaving an exposed portion of the bottom wall 66 between each turbulator 100.

The turbulator 100 need not have a planar shape; for example the back face could be curved in a convex, airfoil-like shape (not shown) so as to maximize Coanda effect in the flow over the turbulator 100 and further discourage flow separation.

In operation, a substantial purge flow of relatively cool air occurs in the secondary air flow path in contact with the back face 56 of the inner band 18. Its velocity is primarily tangential (i.e. into or out of the page in FIG. 1, and in the direction of arrow "F" in FIG. 7). The turbulators 100 create turbulence which increases heat transfer as air passes over them. Their fastback shape prevents stagnation, boundary layer separation, and dust buildup between the turbulators 100.

The "fastback" turbulator structures described above are useable not only in turbine nozzles, but also for any structure requiring heat transfer enhancement, in particular in any structure where prior art turbulators might otherwise be used. Nonlimiting examples of such structures include gas turbine engine combustor liners, stationary (i.e. frame) structures, turbine shrouds and hangers, turbine disks and seals, and the interiors of stationary or rotating engine airfoils such as nozzles and blades. As such, the components described above should be considered as merely one example representative of a heat transfer structure having a wall exposed to fluid flow with turbulators disposed thereon. The fastback turbulators may be incorporated into the casting of a component, may be machined into an existing surface, or may be provided as separate structures which are then attached to a surface. They are believed to be particularly effective in regions of high-speed flow, and where swirl flow dominates.

The foregoing has described a fastback turbulator structure and a pocket geometry for a turbine nozzle band. While specific embodiments of the present invention have been described, it will be apparent to those skilled in the art that various modifications thereto can be made without departing from the spirit and scope of the invention. Accordingly, the foregoing description of the preferred embodiment of the invention and the best mode for practicing the invention are provided for the purpose of illustration only and not for the purpose of limitation.

What is claimed is:

1. A turbine nozzle comprising:

(a) a hollow, airfoil-shaped turbine vane;

(b) an arcuate first band disposed at a first end of the turbine vane, the first band having a flowpath face adjacent the turbine vane, and an opposed back face;

(c) wherein the back face includes at least one open pocket, the at least one pocket defined in part by a bottom wall recessed from the back face, opposed ends of the bottom wall merging with the back face, where the pocket is exposed to fluid flow in a predetermined direction of flow; and (d) a plurality of turbulators disposed on the bottom wall, each turbulator having:

(i) an upright front face which generally faces the direction of flow, and (ii) a back face which defines a ramp-like shape tapering from the front face to the bottom wall of the pocket.

2. The turbine nozzle of claim 1 wherein the turbulators are spaced apart from each other in the direction of flow by a distance of about 8 to 10 times a peak height of the turbulator above the bottom wall.

3. The turbine nozzle of claim 1 wherein each of the back faces forms an angle of about 20 degrees or less with the bottom wall.

4. The turbine nozzle of claim 1 wherein each of the back faces forms an angle of about 7 degrees with the bottom wall.

5. The turbine nozzle of claim 1 wherein each turbulator has a peak height above the bottom wall of about 0.18 mm (0.007 in.) to about 0.64 mm (0.025 in.).

6. The turbine nozzle of claim 1 wherein each turbulator has a peak height above the bottom wall of about 0.25 mm (0.010 in.).

7. The turbine nozzle of claim 1 wherein the back face of each turbulator extends all the way to a root of the front face of a downstream turbulator.

8. The turbine nozzle of claim 1 wherein, excepting the turbulators, the bottom wall is substantially free of interior corners.

9. The turbine nozzle of claim 1 wherein an angled transition region is disposed at each of the opposed ends of the bottom wall where it intersects the back face.

10. The turbine nozzle of claim 1 wherein a radiused transition region is disposed at each of the opposed ends of the bottom wall where it intersects the back face.

11. The turbine nozzle of claim 1 wherein the bottom wall is bounded by opposed forward and aft walls extending between the bottom wall and the back face.

12. The turbine nozzle of claim 11 wherein the forward and aft walls are generally planar and parallel to each other.

13. The turbine nozzle of claim 1 further comprising an arcuate second band disposed at an opposite end of the turbine vane from the first band.

14. The turbine nozzle of claim 1 wherein a plurality of hollow, airfoil-shaped turbine vanes are disposed between the first and second bands.

15. The turbine nozzle of claim 1 wherein the bottom wall comprises a central portion disposed between end portions, each of the end portions forming a ramp between the back face and the central portion of the bottom wall.

16. The turbine nozzle of claim 15 wherein each of the end portions forms an angle of about 20 degrees or less with the back face.

* * * * *